US005109253A

United States Patent [19]

Nakagama et al.

[11] Patent Number: 5,109,253

[45] Date of Patent: Apr. 28, 1992

[54] COPIER TECHNIQUE FOR DETERMINING SPEED AND THRESHOLD NUMBER OF SHEETS FOR A COPIER

[75] Inventors: Kiyohari Nakagama; Satoshi Watanabe; Mitsugu Nemoto, all of Hachioji, Japan

[73] Assignee: Konica Corporation, Tokyo, Japan

[21] Appl. No.: 730,473

[22] Filed: Jul. 16, 1991

[30] Foreign Application Priority Data

Jul. 20, 1990 [JP] Japan ..... 2-192044
Jul. 27, 1990 [JP] Japan ..... 2-200937

[51] Int. Cl.[5] ..... G03G 15/04; G03G 15/00

[52] U.S. Cl. ..... 355/228; 355/243; 355/311; 355/30

[58] Field of Search ..... 355/69, 208, 228, 243, 355/311, 285, 308, 30; 358/486, 498

[56] References Cited

U.S. PATENT DOCUMENTS 4,436,416 3/1984 Negoro et al. ..... 355/243
4,684,237 8/1987 Buchar et al. ..... 355/30 X
5,063,404 11/1991 Millillo ..... 355/30

FOREIGN PATENT DOCUMENTS 56-025754 3/1981 Japan .
62-288876 12/1987 Japan .

*Primary Examiner*—Joan H. Pendegrass
*Assistant Examiner*—P. Stanzione
*Attorney, Agent, or Firm*—Frishauf, Holtz, Goodman & Woodward

[57] ABSTRACT

A copying apparatus is adapted to suppress the temperature rise of a platen glass by decreasing the copy speed from a first speed to a second speed after the apparatus has copied a threshold number of sheets in succession. The above parameters of the first speed, the second speed and the threshold number are basically predetermined based on the size of the copy paper and the magnification in copying, and modified based in accordance with the source voltage of a lamp to emit scanning light to scan an original on the platen glass.

3 Claims, 11 Drawing Sheets

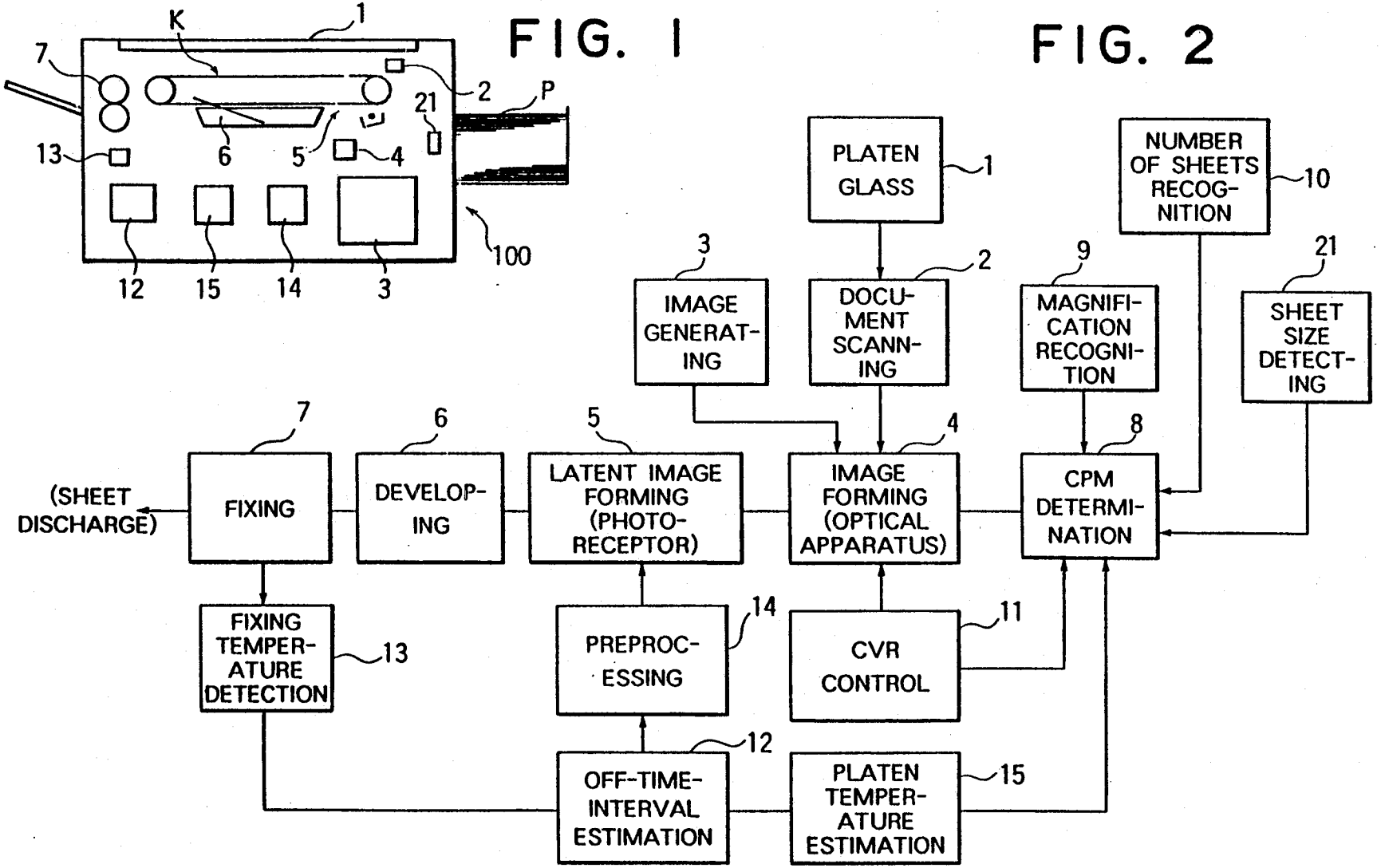
FIG. 1
FIG. 2
PLATEN GLASS
DOCU-MENT SCANN-ING
IMAGE GENERAT-ING
IMAGE FORMING (OPTICAL APPARATUS)
LATENT IMAGE FORMING (PHOTO-RECEPTOR)
DEVELOP-ING
FIXING
(SHEET DISCHARGE)
NUMBER OF SHEETS RECOG-NITION
MAGNIFI-CATION RECOGNI-TION
SHEET SIZE DETECT-ING
CPM DETERMI-NATION
CVR CONTROL
PREPROC-ESSING
FIXING TEMPER-ATURE DETECTION
OFF-TIME-INTERVAL ESTIMATION
PLATEN TEMPER-ATURE ESTIMATION
P
K
100

( COPY 105 >

< CPM DOWN 109 >

COPIER TECHNIQUE FOR DETERMINING SPEED AND THRESHOLD NUMBER OF SHEETS FOR A COPIER

BACKGROUND OF THE INVENTION

The present invention relates to improvements in an electrophotographic copier.

In general, an image is formed in this kind of copier in such a manner that: a document placed upon a platen glass is exposed to light emitted by a lamp for document-image reading use; an electrostatic latent image is formed by the reflected light on a photoreceptor drum, on the surface of which a photoconductive material such as an organic photosensitive material is coated; the electrostatic latent image is developed by a developing section so that a toner image can be formed; the toner image is transferred onto a recording paper; and the transferred image is thermally fixed by a fixing section.

In a conventional copier, when a platen glass is heated to more than a predetermined temperature by a lamp for document-image reading use, there is a possibility that an operator of the copier is psychologically and physically damaged by the heat of the lamp. Especially, in the case of an electrophotographic copier to be sold in U.S.A., a raise in temperature is strictly regulated by the requirements of the UL Standards. Therefore, the following countermeasures are adopted for a conventional copier:

(1) Temperature of the platen glass is measured sensor, and when the measured temperature exceeds a predetermined value, the value of CPM (which is the number of copied papers per unit time) is lowered.

(2) According to the copying magnification, the value of CPM is lowered so that it can be a predetermined value which has been previously set.

However, in the aforementioned conventional image forming apparatus, there are problems which will be described as follows:

In the case of (1) in which the temperature sensor is utilized, the cost and man hour are increased, and the apparatus becomes complicated.

In the case of (2) in which the value of CPM is determined according to the copying magnification, there is a possibility that the processing speed is unnecessarily lowered and the performance of the apparatus can not be exhibited.

SUMMARY OF THE INVENTION

In order to solve the aforementioned conventional problems, the present invention has been achieved, and it is a primary object of the present invention to provide a copier in which overheat of a platen glass can be prevented without using a specific thermal sensor while the performance of the apparatus is exhibited maximally.

In order to attain the aforementioned object, the copier of the present invention comprises: a detection means to detect the number of recording papers which have been continuously processed; a means to set a predetermined CPM value in accordance with the detected number, wherein when the copying number has reached a predetermined value, the copying speed can be lowered to a predetermined value. In the copier of the present invention, a copying number is previously determined in accordance with the copy paper size and copying magnification, and when the copying number has reached the predetermined value, the copying speed is lowered.

In order to accomplish the aforementioned object, the copier of the present invention is composed in such a manner that: each time the continuous copying number exceeds a predetermined threshold value, the copying number per unit time can be lowered; and is provided with a means by which the starting time to lower the copying number can be delayed according to the voltage of the lamp for document-image reading use. In order to accomplish the aforementioned object, the copier of the present invention comprises: a detection means to detect the continuous copying number, paper size and copying magnification; a computing means to compute according to the following equation, $$[\text{Effective heating value}]=[\text{Paper size}]\times[\text{Copying magnification}],$$

wherein the CPM value can be changed according to the continuous copying number and effective heating value and further the CPM value can be finely adjusted.

BRIEF DESCRIPTION OF THE DRAWINGS

FIG. 1 is a schematic illustration showing the composition of the apparatus of the present invention;

FIG. 2 is a block diagram showing an embodiment of the present invention;

FIG. 7 is a main flow;

FIG. 8 is a copying speed decrease sub-routine;

FIG. 9 is a flow chart showing copying operations;

FIG. 10 is a flow chart used in the estimation of platen glass temperature when the platen glass is left to be cooled;

DETAILED DESCRIPTION OF THE PREFERRED EMBODIMENTS

The theoretical basis of the off-time measuring method in which the heat-radiation-with-time property is utilized, will be explained as follows, wherein the off-time measuring method is used in the copier of the present invention.

First, the heat-radiation-with-time property of the surface temperature of a fixing roller can be approximately expressed by the following equation on the assumption that the temperature inside the apparatus is constant regardless of the outside temperature, $$T(\tau)=K\exp(-\tau/\eta)+C \quad (1)$$

where the temperature with time=T, the initial temperature=190° C., the proportional constant=K, the temperature inside the apparatus=25° C., the time constant=$\eta$, the off-time=$\tau$, , and the undecided constant=C.

Figure 6:
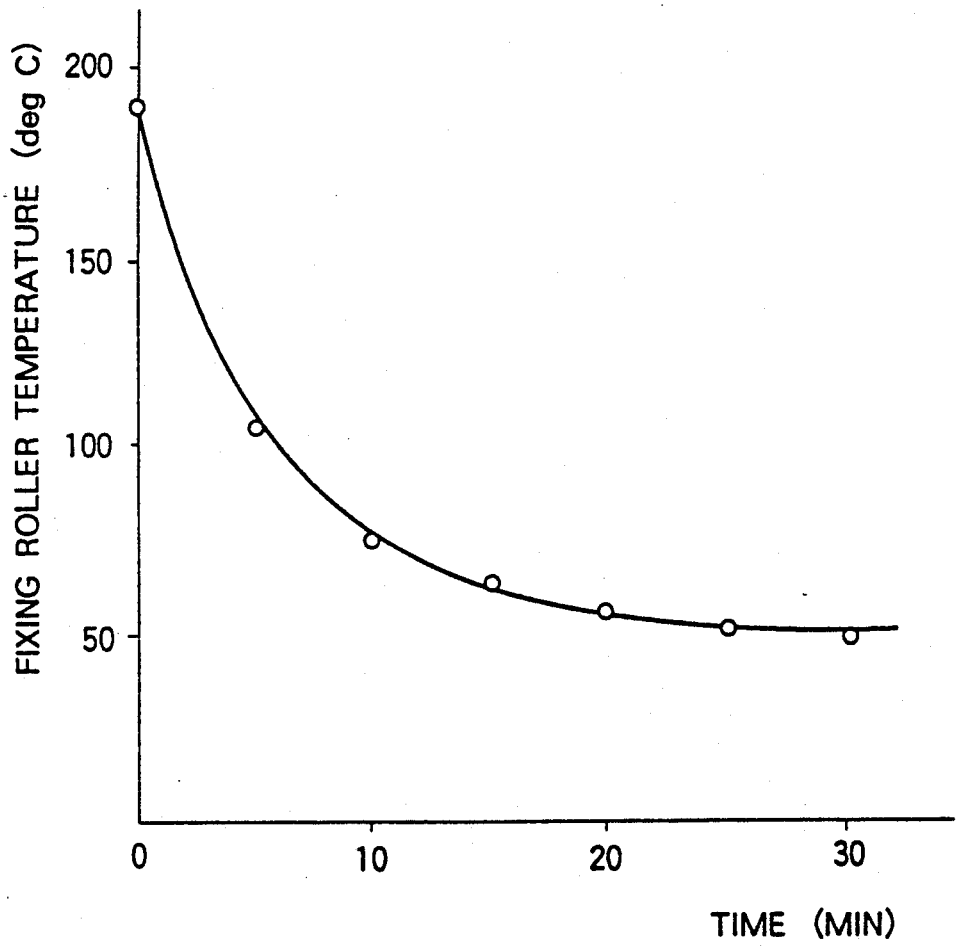
FIG. 6, is a characteristic diagram showing the change of the temperature of a fixing roller when heat is radiated.

FIG. 6 is a heat radiation characteristic diagram of a temperature-rising portion (a fixing roller) of the apparatus of the present invention $$\text{where } T(0) = K + C = 190^\circ \text{ C.}$$
$$T(\infty) = C = 25^\circ \text{ C.}$$

Consequently, the following result can be obtained.

$$K = T(0) - T(\infty) = 190 - 25 = 165$$

Namely, the following equation can be satisfied.

$$T(\tau)=165\exp(-\tau/\eta)+25 \quad (1)'$$

When, $\tau/\eta=1$, that is, when $\exp(-\tau/\eta)=0.368$, $T(\tau)=86$(° C.), the following result can be obtained, $\tau=10$ (minutes), so that the time constant $\tau$ can be expressed as follows.

$$\eta=10$$

When the influence of the outside temperature is taken into consideration, the aforementioned equation (1)'can be expressed as follows $$T=165\exp(-\tau/10)+25+\alpha \quad (2)$$

where $\alpha$ is a correction value showing the influence of the difference in temperature between the apparatus body and the atmosphere. The following approximate expression of the correction value $\alpha$ is used.

$$\alpha=(T_R-25)(1-\exp(-\tau/20))$$

where $T_R$: Room temperature. In this case, when T(10) and T(20) are computed with regard to the room temperatures of $T_R$=10°, 20°, 30° C., the estimated errors $\Delta T$ are as follows.

$$\Delta T=\pm 1 \text{ minute}$$

$$\Delta T=\pm 2 \text{ minutes}$$

Therefore, the error caused when the off-time is estimated from the temperature of the temperature rising portion, is±10% which is sufficiently small, so that it can be understood that the time can be measured with an accuracy which causes no problem in practical use. The influence given to the process control by this kind of error, can be previously estimated so that the error does not have any influence on the control.

Referring to an embodiment shown in the attached drawings, the present invention will be explained as follows.

Figure 3:
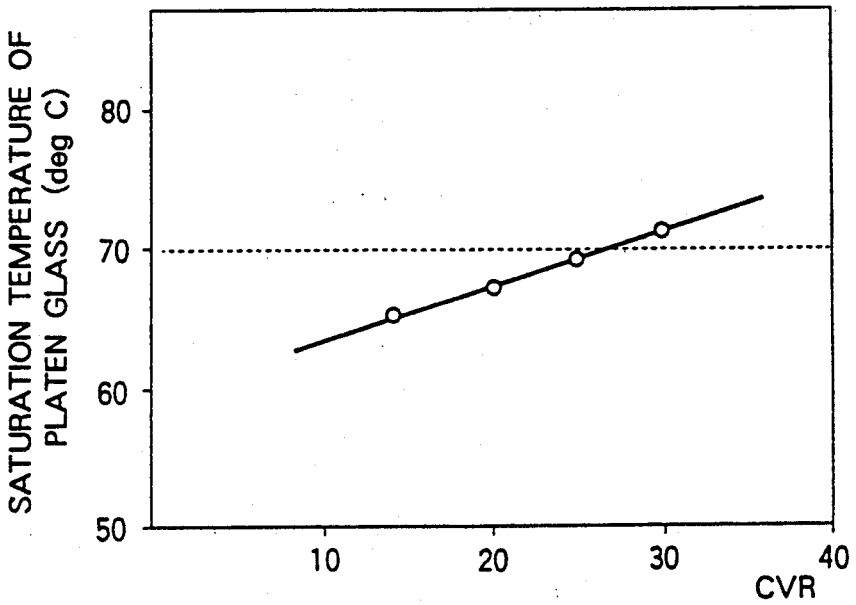
FIG. 3 is a characteristic diagram showing the relation between the saturated temperature of a platen glass in the case of a continuous copying operation and the CVR value, which is the voltage of a lamp for document-image reading use.
Figure 4:
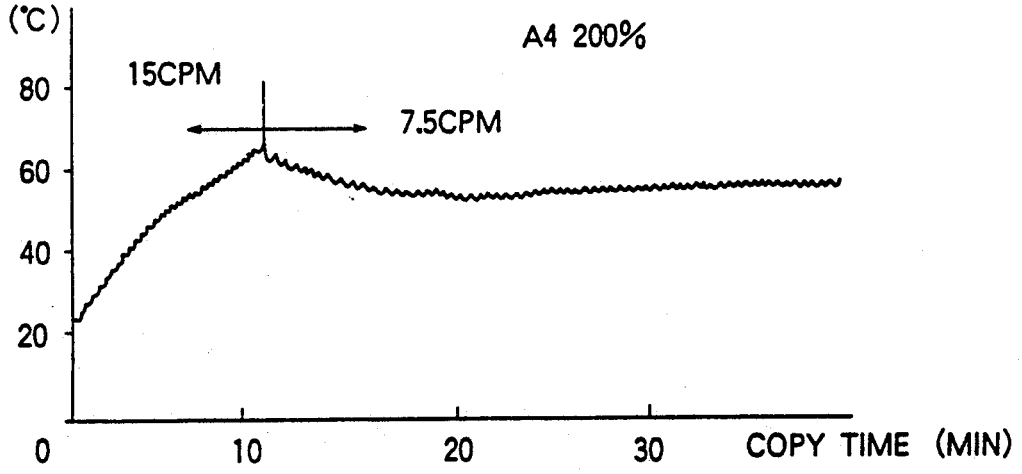
FIG. 4 is a graph showing the change of platen glass temperature when the CPM value is lowered in an experiment.
Figure 5:
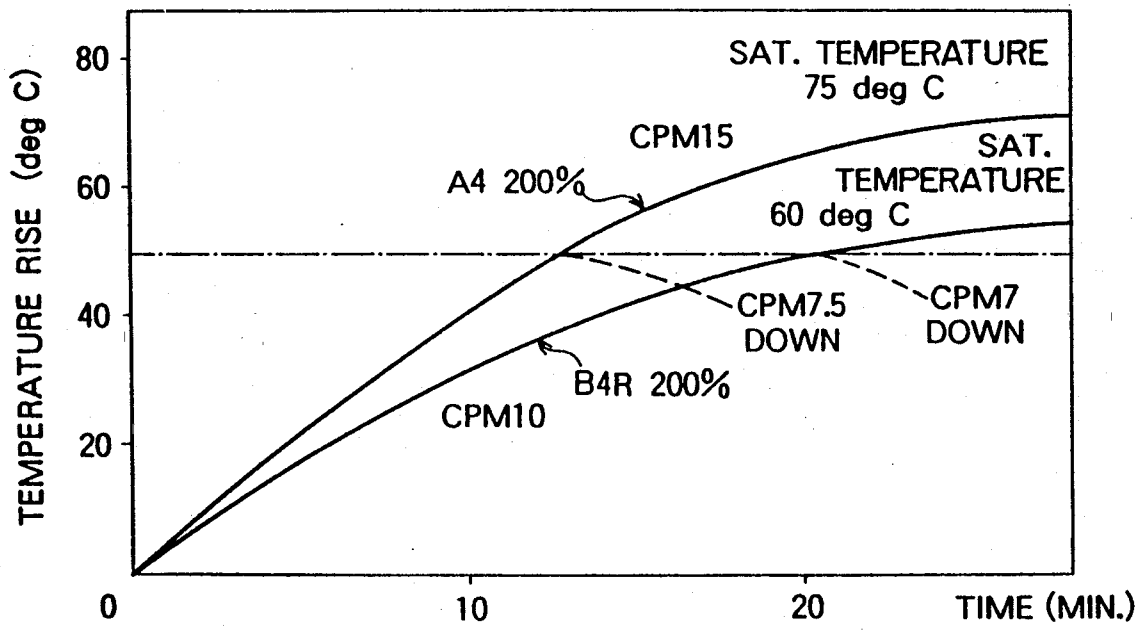
FIG. 5 is a characteristic diagram showing the raise in platen glass temperature, wherein the paper size and copying magnification are varied.

FIG. 1 is a schematic drawing showing the essential composition of the apparatus of the present invention, and FIG. 2 is a block diagram. FIG. 3 is a characteristic diagram showing the relation between the saturated temperature of a platen glass and the CVR values. FIG. 4 is a graph showing the variation of platen glass temperature in an experiment in which the CPM value was lowered. FIG. 5 is a graph showing the relation between the platen glass temperature and the magnification, and the relation between the platen glass temperature and the paper size.

In FIGS. 1 and 2, numeral 1 is a platen glass, which is provided on the upper surface of an apparatus body 100 of the present invention. A document to be copied is placed on the platen glass 1, and the document is optically scanned by light emitted from a lamp installed in a document reading-out section 2 so that the image information formed by reflected light can outputted into an image forming section 4.

Numeral 3 is an image generating section, which extracts an image, letter and graphic pattern from a predetermined storage unit or signal transmitting unit (which are not illustrated in the drawings) so that the extracted image information can be outputted into the aforementioned image forming section 4. The aforementioned image generating section 3 is utilized when an image is formed without depending on the method of copying, or when different kinds of images characters or patterns are added to a copied image. In the case where the apparatus body 100 is composed in such a manner that the apparatus is exclusively used for copy use, the image generating section 3 may be omitted.

Numeral 5 is a latent image forming section, which is provided with a photoreceptor K (a drum or belt) and converts the image formed by light in the aforementioned image forming section 3 into an electrostatic latent image. In this case, when the off-time (which is a period in which the power source is turned off) exceeds a predetermined period of time, photoreceptor K is charged in a pre-processing section 14 so that a sufficient electric charge can be given.

Figure 9:
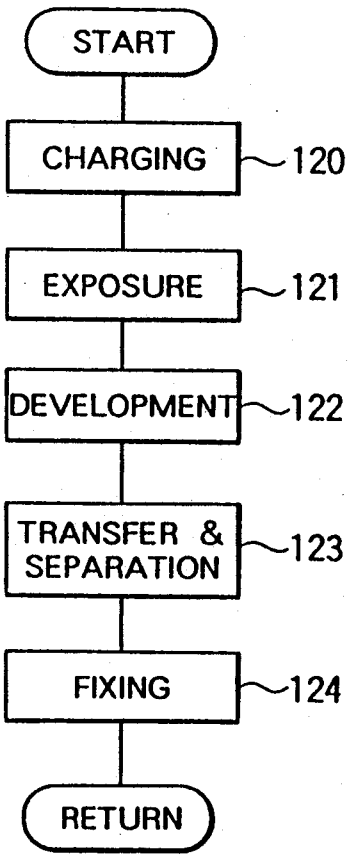
Figure 8:
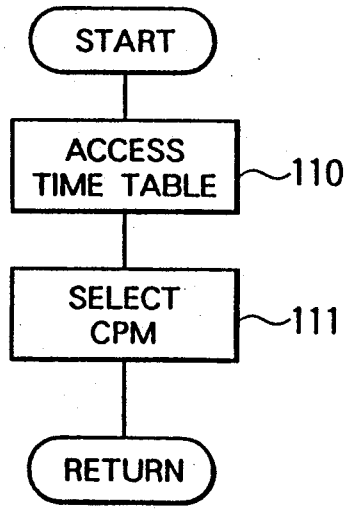
Figure 10:
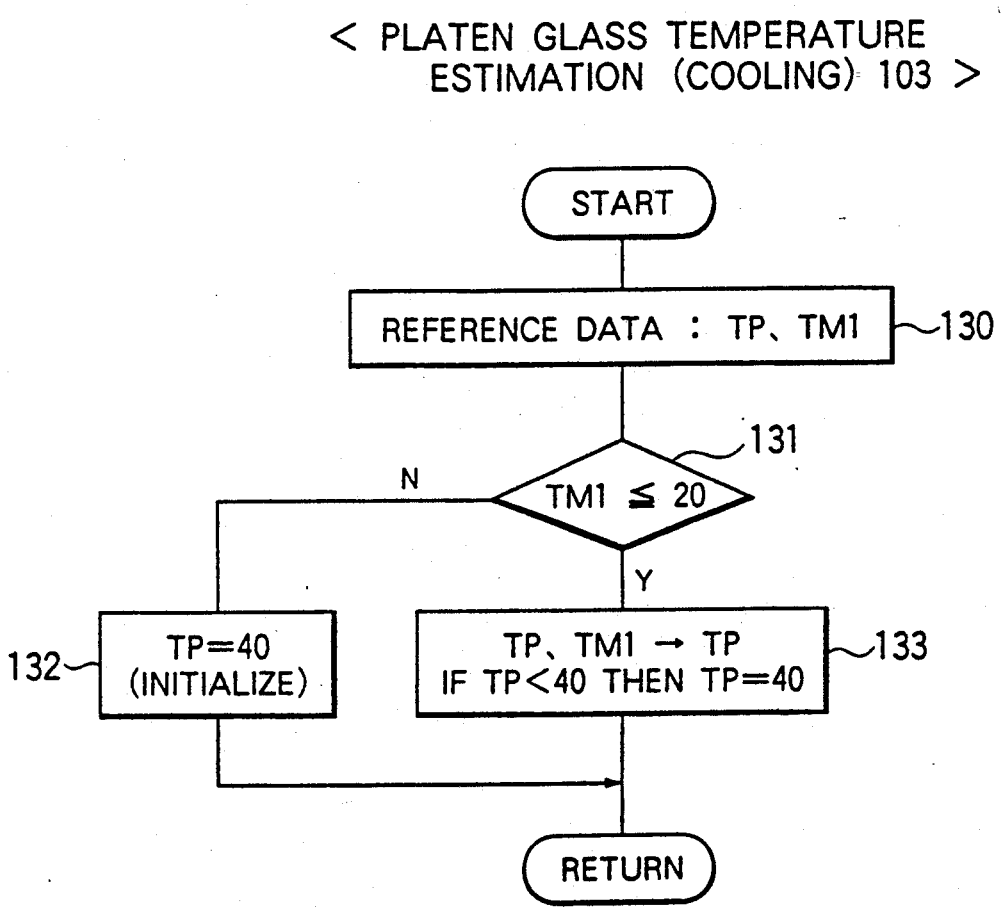
Figure 11:
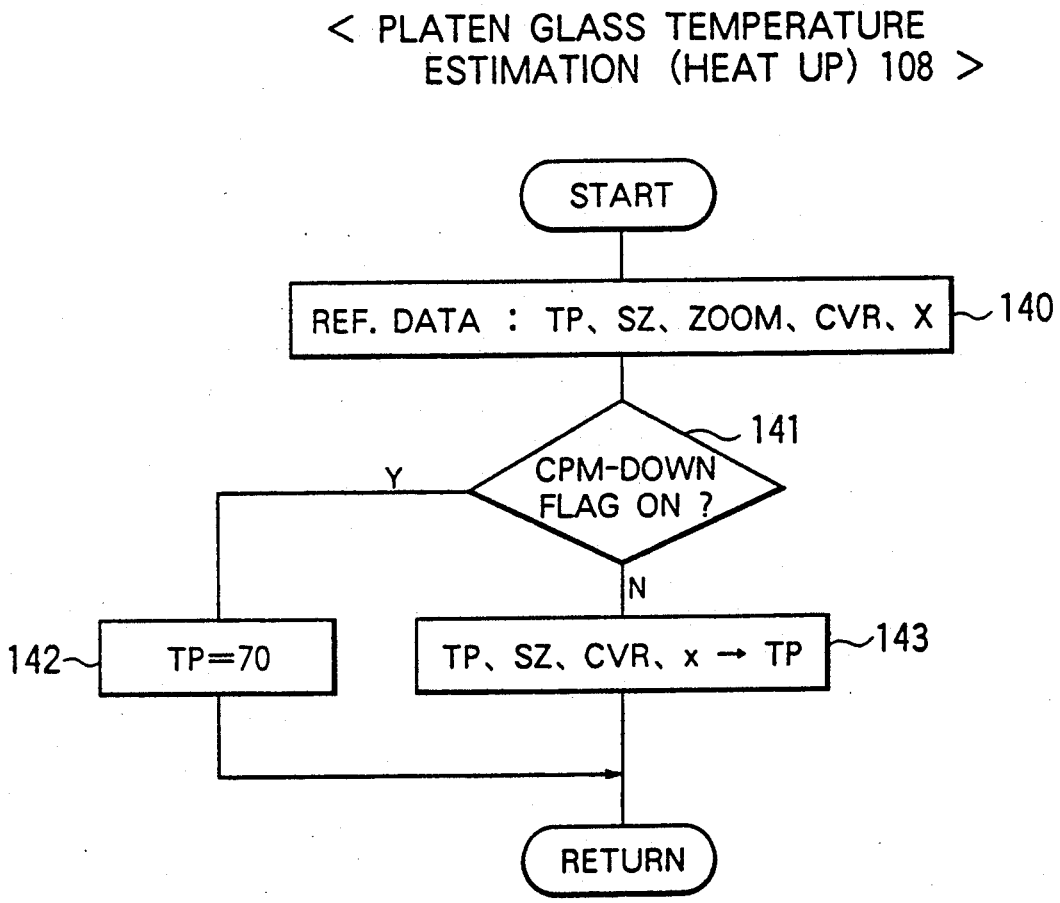
FIG. 11 is a flow chart used in the estimation of platen glass temperature when the temperature is raised.
Figure 12:
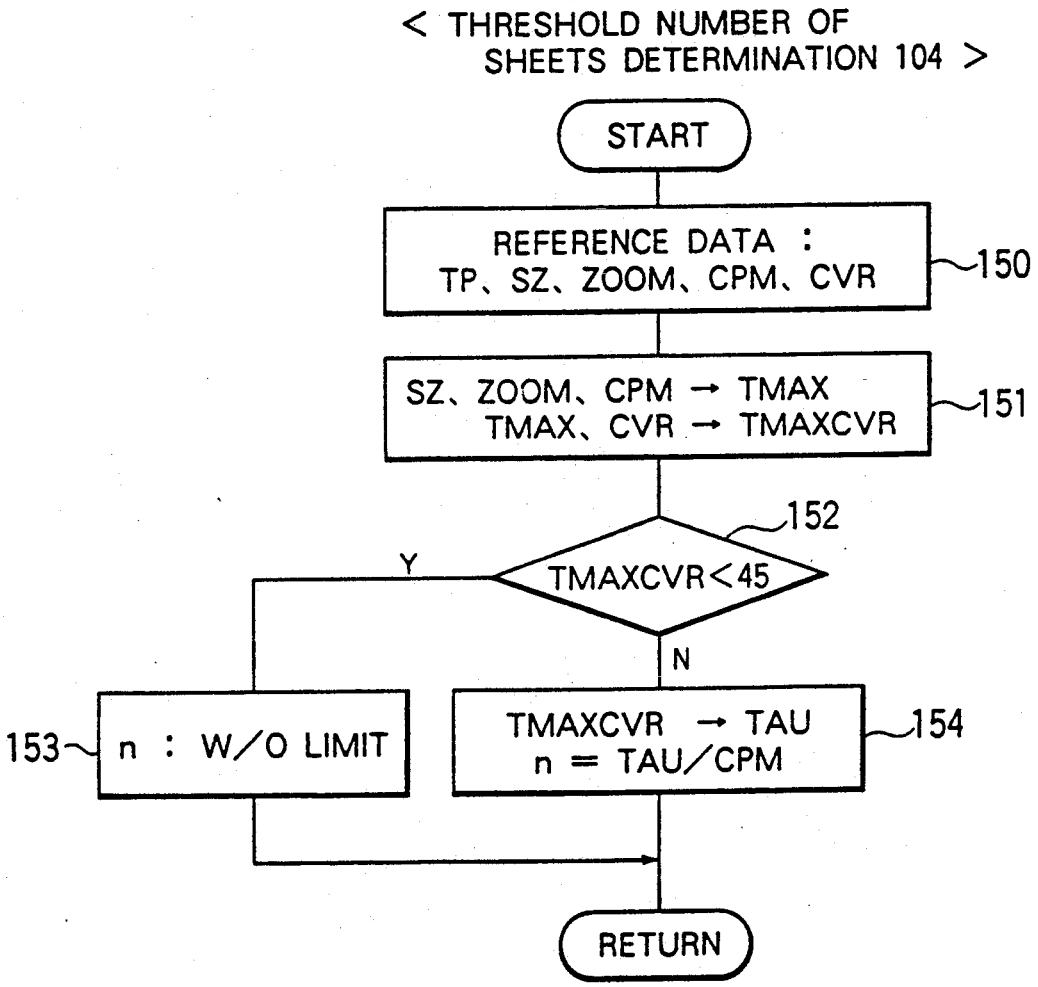
FIG. 12 is a sub-routine to determine the copying number "n" which is the number of copying operations form the beginning to the start of decrease of copying speed.

Numeral 6 is a developing section, which adheres toner onto an electrostatic latent image formed on the surface of the photoreceptor by the aforementioned latent image forming section 5. A recording paper is conveyed to a fixing section 7 and the toner image is thermally fixed, and then the recording paper is discharged to the outside of the apparatus. (Refer to FIG. 9.)

Numeral 8 is a CPM setting section, which is used for setting the processing speed (which is the number of recording papers processed in a minute) in accordance with the following various conditions of copying.

(1) Copying magnification
(2) Number of copying papers to be processed continuously
(3) CVR value (Voltage of a lamp provided in the document image reading-out section 2)
(4) Temperature of the platen glass The CPM value can be appropriately set according to the above-described conditions.

According to (1) described above, the information of the magnification input section 9 is inputted into the CPM setting section 8, and according to (2) described above, the information of the copy number input section 10 is inputted into the CPM setting section 8. In the CPM setting section 8, a plurality of CPM values have been set, and the most optimum value can be selected in accordance with the magnification and continuous processing number.

FIG. 5 shows the change of the rise of platen glass temperature with regard to the magnification and continuous processing number, wherein the magnification is 200% in the case of A4 size, and the magnification is 200% in the case of B4 size. As shown in the graph of FIG. 5, when the CPM value is reduced in the middle of the process, the temperature rise can be controlled to not more than 45° C., and the temperature rise is saturated as illustrated by a dotted line in the graph.

Concerning the CVR values of the aforementioned (3), in the initial adjustment of the aforementioned apparatus body 100, the voltage which has been set in the CVR adjusting section 11 is inputted. This CVR value is approximately proportional to the heat generated by the lamp of the document reading-out section 2, so that the CVR value is an important factor to control the temperature rise of the platen glass. FIG. 3 shows the relation between the CVR value and the saturated temperature of the platen glass. For example, overheat of the platen glass can be prevented in such a manner that: when a continuous processing number has exceeded a predetermined threshold value, the CPM value which was determined according to the paper size and magnification, is lowered. In this case, if the heat generated by the lamp is more precisely evaluated referring to the CVR value, the timing to lower the CPM value can be adjusted based on the CVR value. In the manner described above, two demands can be compatible with each other, one is the prevention of temperature rise of the platen glass, and the other is to exhibit the processing performance of the apparatus of the present invention.

Concerning (4) the temperature of the platen glass, it is not desirable to install a temperature sensor close to the platen glass 1, because the structure becomes complicated and the cost is increased. In this embodiment, the temperature of the platen glass is computed in the platen glass temperature computing section 15 according to the off-time found by the off-time computing section 12 and the heat radiating property, namely the cooling characteristics model of the platen glass which has been previously determined. The temperature of the platen glass can be used for the control to lower the CPM value referring to the parameters such as a paper size, magnification and CVR value.

Numeral 12 is an off-time computing section. The off-time computing section 12 can compute the elapsed time which has passed after the copying operation was stopped, according to the output information of the temperature detecting section 13 provided in an appropriate temperature rise position (in this embodiment, in a position on the surface of the thermal fixing roller) in the aforementioned fixing unit 7 and according to the heat-radiation-with-time property of the aforementioned temperature rise position which has been previously determined. The heat-radiation-with-time property of the aforementioned temperature rise position is stored in the off-time computing section 12 in the form of a map, and the map is reversely indexed according to the output information of the aforementioned temperature detecting section 13 so that the off-time can be estimated. It is judged according to the off-time found in the computing section 12 whether the charging processing is conducted or not. At the same time, the estimation of the platen glass temperature is also performed in the aforementioned platen glass temperature computing section 15. The theoretical consideration for measuring time using the heat-radiation-with-time property has been described above.

In the above-described embodiment, in the case of a copying mode, a document is placed on the platen glass 1, the document image is read out by the document image reading-out section 2, and the obtained image information is sent to the image forming section 4. On the other hand, in the CPM setting section 8, the CPM value is appropriately determined in accordance with the outputs of the magnification setting section 9, the number of sheets recognizing section 10 to count up number of copied number of sheets, the CVR adjusting section 11, and the platen glass temperature computing section 15. The time to lower the CPM value according to the magnification and paper size is appropriately delayed referring to the CVR value of the CVR adjusting section 11.

After an optical image formed on the surface of photoreceptor K in the latent image forming section 5 has been converted into an electrostatic latent image, the latent image is developed into a toner image by the developing section 6. The toner image is thermally fixed by the fixing section 7, and the recording paper is discharged to the outside of the apparatus. While the aforementioned process is being conducted, an appropriate position of the fixing section 7 is measured by the temperature detecting section 13, and the off-time is computed from the measured temperature by the off-time computing section 12. On the basis of the off-time, it is judged whether a charging process is conducted on photoreceptor K by the preprocessing section 14 or not. Furthermore, on the basis of the off-time, the temperature of the platen glass is computed by the platen glass temperature computing section 15.

Referring to FIGS. 7–12, the setting flow of the copy speed CPM will be explained.

Figure 7:
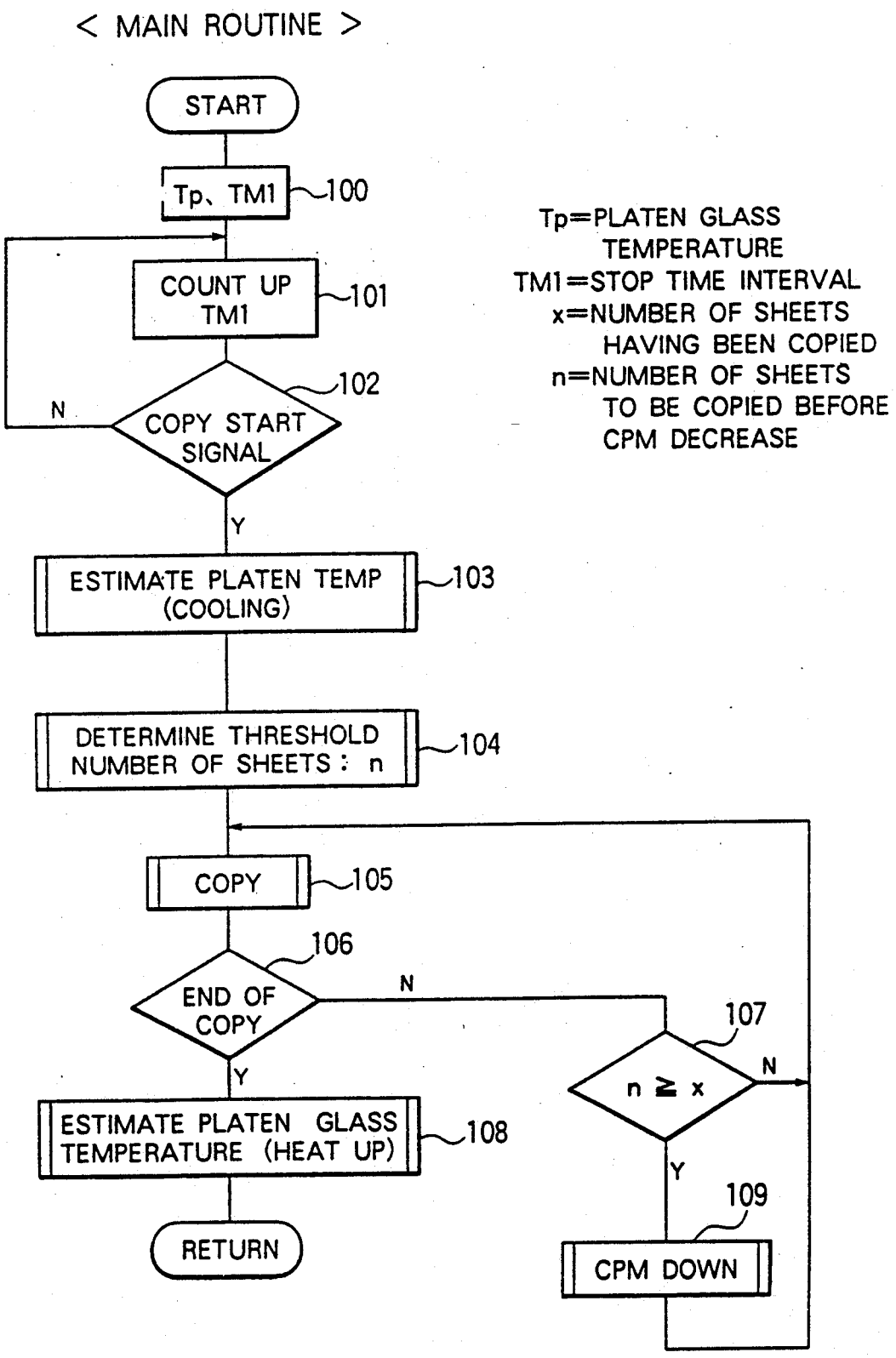
FIG. 7 to FIG. 10 are flow charts showing examples of the control processing routine of the present invention.

In step 100 in FIG. 7, the initial setting values of the platen glass temperature and continuous copy number are determined by the values previously estimated or detected. When the copying operation is not conducted, stoppage time TM1 is counted according to steps 101 and 102. When the copying operation has been started, the off-time is estimated from the aforementioned fixing roller temperature (step 103), and the continuous copy number n is estimated under the condition of a constant CPM (step 104). After a copying process corresponding to a sheet of copy paper has been completed (step 105), it is checked whether all copies have been completed or not (step 106). Then, the present copy number x is compared with the setting copy number n, and when the present copy number x is not less than the setting copy number n, a slow copy speed is selected (step 109). When the copying operation has been completed (step 106), the temperature rise at that moment is estimated (step 108), and the process is returned to the start. The details of the aforementioned steps 103, 104, 105, 108 and 109, are shown in FIGS. 8–11.

Figure 13:
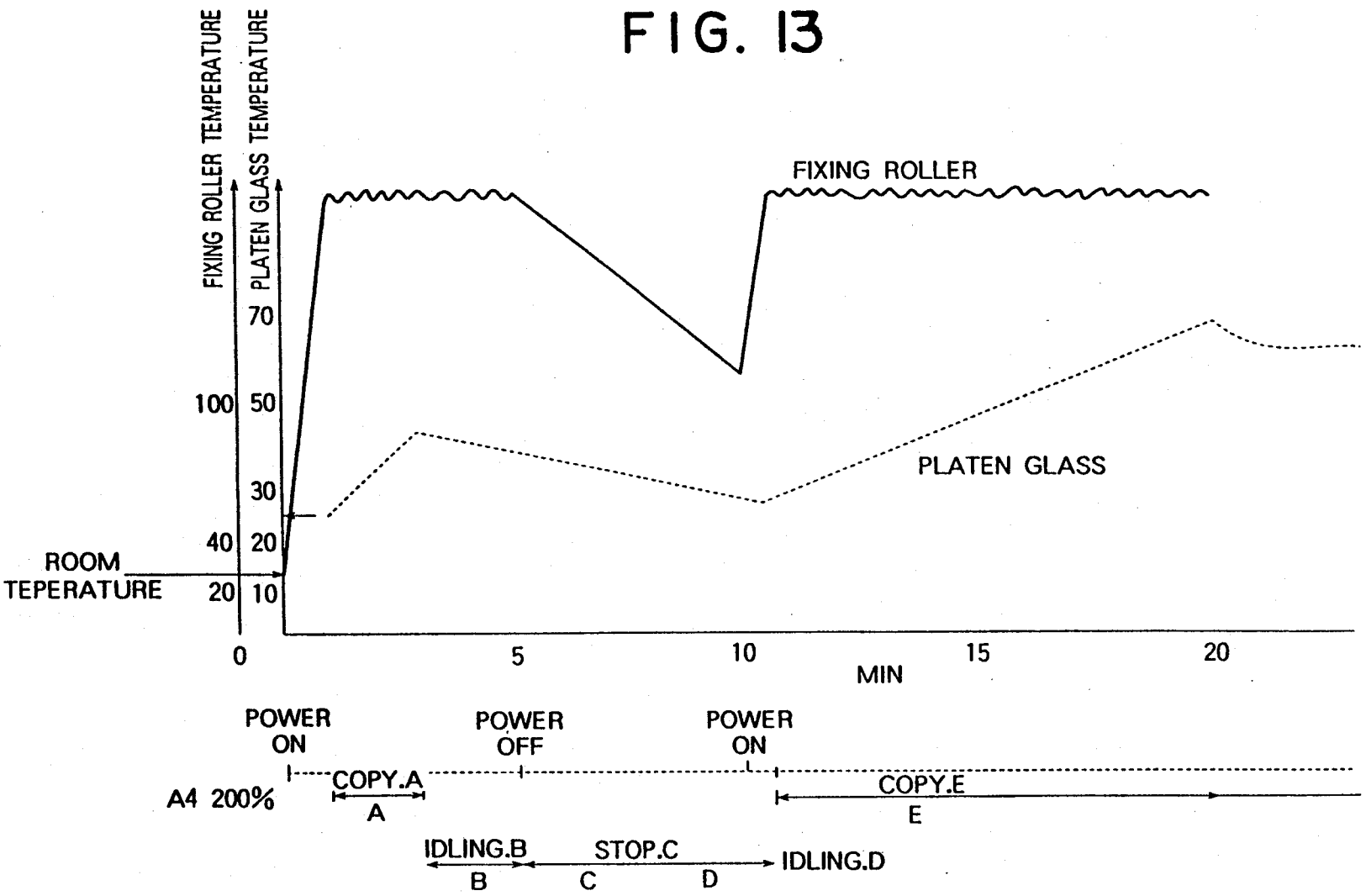
FIG. 13 is a graph showing the variation of temperature of a fixing roller and platen glass.

Referring to a time chart in FIG. 13, an example of the estimating method will be explained. In FIG. 13, time A and E are copying operation times, time B and D are idling times (which correspond to the time for heating a fixing roller and the time of copying operation stop), and time C is a heat radiating time of the fixing roller.

Time C in which the power source is turned off can be found from the lowered temperature of the fixed roller as described before. While the power source is turned on, the time is always measured by a counter and stored, so that times A, B, C, D, and E can be found whenever if necessary. For example, heat radiating time B+C+D of the platen glass (which is a time in which a copying operation is stopped) is shorter than a predetermined time, the temperature drop caused by heat radiation is neglected, and the time to lower the CPM value is estimated on the assumption that continuous copying time A minutes have already passed at the start point of copy operatio:. E. In the case where time B+C+D is longer than the predetermined time, the time to lower the CPM value is estimated on the assumption that the initial temperature of the platen glass is the room temperature 25° C.

Figure 14:
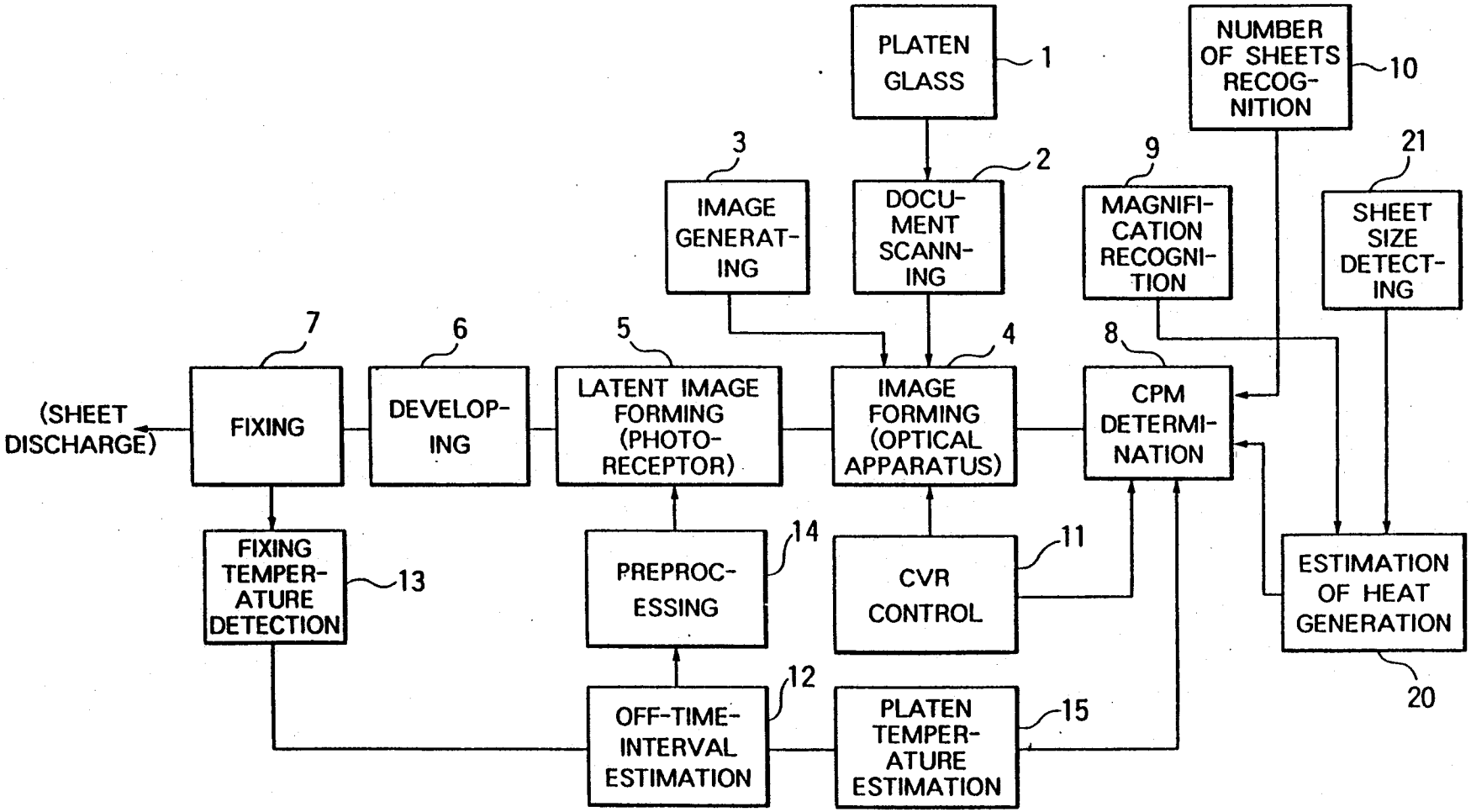
FIG. 14 is a block diagram showing another embodiment of the present invention.

FIG. 14 is a block diagram of another embodiment of the present invention. In this embodiment, the time to lower the CPM value is set in the CPM setting section 8 in such a manner that: the output signals of the paper size and magnification sent from the copy paper size detector 21 and the magnification identifying means 9 are utilized, and the generated heat is found by the generated heat estimating section 20.

As described above, the copier of the present invention is characterized in that: each time when the continuous copy number exceeds a predetermined threshold value, the copy number per unit time is reduced; and the time to lower the aforementioned copy number can be selected from a plurality of setting values according to the processing speed, the copy paper size, the magnification and the CVR voltage. Therefore, overheat of the platen glass can be prevented without installing a temperature sensor on the platen glass and without lowering the processing speed extremely.

What is claimed is:

1. A copying apparatus being adapted to decrease the copying speed in number of sheets per unit time from, a first speed to a second speed after a threshold number of sheets having been successively copied, comprising:

means for determining the first speed, the second speed and the threshold number of sheets before starting the copying;

means for modifying the threshold number of sheets based on at least one of three parameters of the size of a copy paper, the magnification of copying and the source voltage applied to a lamp to emit scanning slight to scan an original.

2. The copying apparatus of claim 1, wherein the determining means determines said first speed, said second speed, and said threshold number of sheets based on the size of the copy paper and the magnification, and the modifying means modifies the threshold number based on the source voltage.

3. The copying apparatus of claim 2, wherein the determining means determines said first speed, said second speed, and said threshold number of sheets based on the multiplication value of the size and the magnification.

* * * * *